US010167070B2

(12) United States Patent
Weber et al.

(10) Patent No.: US 10,167,070 B2
(45) Date of Patent: Jan. 1, 2019

(54) MARINE ELECTRIC POWER STEERING SYSTEM WITH CABLE ASSEMBLY

(71) Applicant: Steering Solutions IP Holding Corporation, Saginaw, MI (US)

(72) Inventors: John E. Weber, Pinconning, MI (US); Brant R. Colbry, Summerville, SC (US); Matthew R. Burk, Bay City, MI (US)

(73) Assignee: STEERING SOLUTIONS IP HOLDING CORPORATION, Saginaw, MI (US)

( * ) Notice: Subject to any disclaimer, the term of this patent is extended or adjusted under 35 U.S.C. 154(b) by 106 days.

(21) Appl. No.: 15/293,724

(22) Filed: Oct. 14, 2016

(65) Prior Publication Data

US 2017/0106962 A1 Apr. 20, 2017

Related U.S. Application Data

(60) Provisional application No. 62/242,394, filed on Oct. 16, 2015.

(51) Int. Cl.

| | |
|---|---|
| ***B63H 25/10*** | (2006.01) |
| ***B63H 25/02*** | (2006.01) |
| ***B63H 20/12*** | (2006.01) |

(52) U.S. Cl.
CPC ..... *B63H 25/02* (2013.01); *B63H 20/12* (2013.01); *B63H 2025/022* (2013.01)

(58) Field of Classification Search
CPC .... B62D 3/02; B63H 20/12; B63H 2025/022; B63H 21/22; B63H 25/10; B63H 25/20
See application file for complete search history.

(56) References Cited

U.S. PATENT DOCUMENTS

2011/0117799 A1* 5/2011 Harada ..... B63H 25/20 440/58

* cited by examiner

*Primary Examiner* — Andrew Polay
(74) *Attorney, Agent, or Firm* — Cantor Colburn LLP

(57) ABSTRACT

A marine electric power steering system includes an actuator assembly, a gear assembly, and a cable assembly. The actuator assembly has an actuator assembly input and an actuator assembly output. The actuator assembly input is operatively connected to a steering shaft that extends along a steering column axis. The gear assembly includes a first gear that is driven by a second gear and a crank arm extending from the first gear. The cable assembly extends from an end of the crank arm to a steering device.

16 Claims, 1 Drawing Sheet

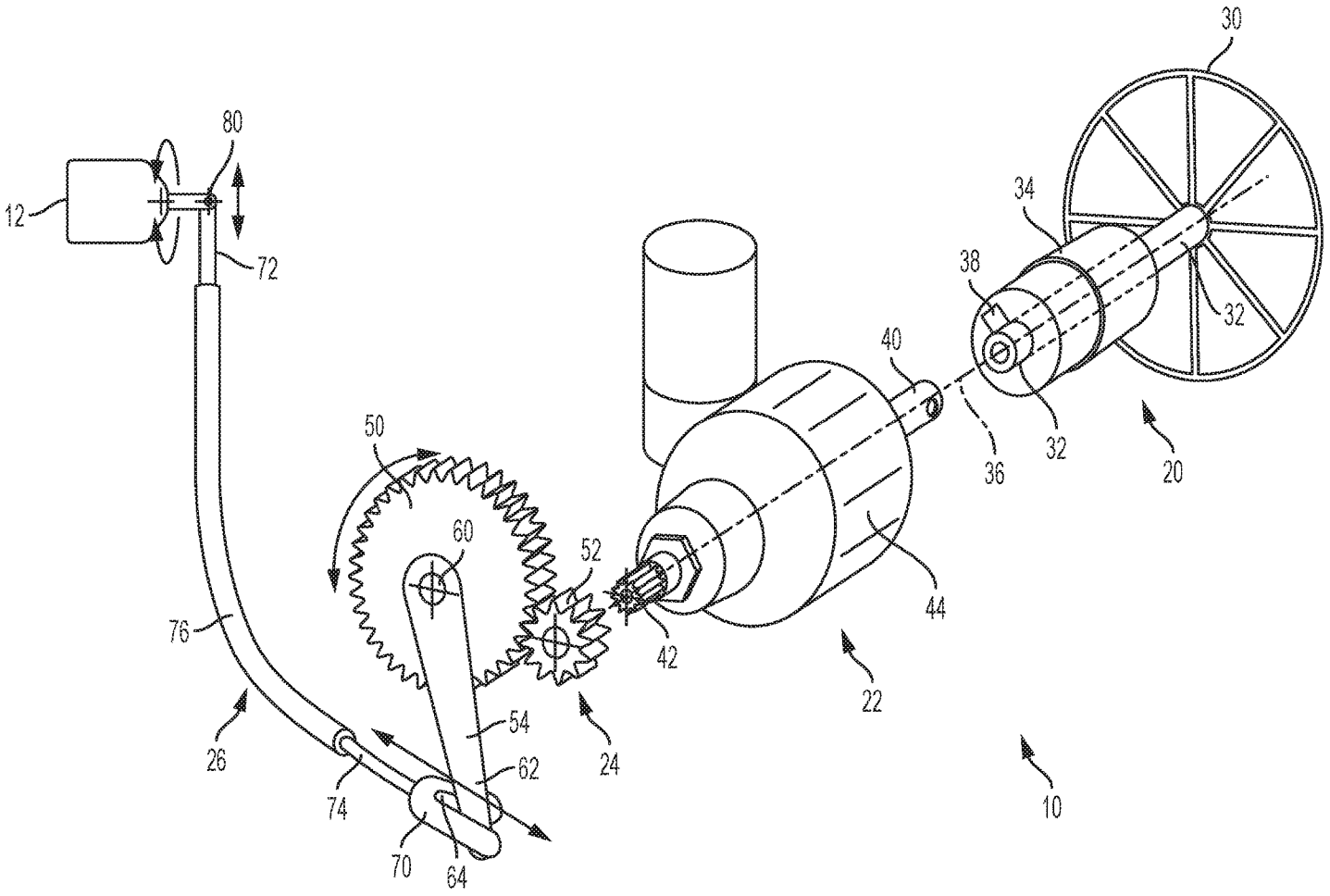
30
32
20
34
32
38
36
10
40
44
22
42
24
52
54
62
60
64
50
70
74
80
72
26
76
12

MARINE ELECTRIC POWER STEERING SYSTEM WITH CABLE ASSEMBLY

CROSS-REFERENCES TO RELATED APPLICATIONS

This patent application claims priority to US Provisional Patent Application Ser. No. 62/242,394, filed Oct. 16, 2015 which is incorporated herein by reference in its entirety.

BACKGROUND OF THE INVENTION

Marine vessels equipped with outboard motors conventionally use a steering system having a steering wheel remotely located from the outboard motor. The steering system generally incorporates hydraulic systems including a hydraulic motor, a hydraulic pump, a hydraulic fluid tank, hydraulic valves, and switches to assist and/or smooth out the loads encountered when steering. The hydraulic steering systems may present challenges such as high cost, possible hydraulic fluid leaks, high energy usage, and difficulty in installing.

SUMMARY OF THE INVENTION

According to an embodiment of the present disclosure, a marine electric power steering system is provided. The marine electric power steering system includes an actuator assembly, a gear assembly, and a cable assembly. The actuator assembly has an actuator assembly input and an actuator assembly output. The actuator assembly input is operatively connected to a steering shaft that extends along a steering column axis. The gear assembly includes a first gear that is driven by a second gear and a crank arm extending from the first gear. The cable assembly extends from an end of the crank arm to a steering device.

According to another embodiment of the present disclosure, a marine electric power steering system is provided. The marine electric power steering system includes an actuator assembly, a step down gear assembly, and a cable assembly. The actuator assembly has an actuator assembly input that is operatively connected to a steering shaft and an actuator assembly output. The step down gear assembly is operatively connected to the actuator assembly output. The step down gear assembly includes a crank arm that is pivotally connected to a first gear. The cable assembly is operatively connected to the crank arm and a steering device.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

FIG. 1 is a disassembled view of a marine electric power steering system.

DETAILED DESCRIPTION

Referring now to the FIGURES, where the invention will be described with reference to specific embodiments, without limiting same, it is to be understood that the disclosed embodiments are merely illustrative examples of the present disclosure that may be embodied in various and alternative forms. The FIGURES are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Referring to FIG. 1, a marine electric power steering system 10 is shown. The marine electric power steering system 10 may be provided with a marine vessel such as a boat. The marine electric power steering system 10 is operatively connected to a steering device 12. The marine electric power steering system 10 is configured to pivot or rotate the steering device 12 to steer the marine vessel without employing a hydraulic system. The steering device 12 may be an outboard motor that is pivotally or movably connected to a marine vessel structure. The marine electric power steering system 10 employs electric power assist components to assist an operator in steering the marine vessel.

The marine electric power steering system 10 includes a helm 20, an actuator assembly 22, a gear assembly 24, and a cable assembly 26.

The helm 20 includes a steering wheel 30 that is connected to a steering shaft 32 that extends into a steering column 34 along a steering column axis 36. An operator of the marine vehicle is able to provide a steering input into the steering wheel 30 such that the steering shaft 32 and the steering wheel 30 rotate about the steering column axis 36.

The helm 20 further includes a steering sensor 38. The steering sensor 38 is arranged or positioned to measure or to monitor a rotational position or an angular position of the steering shaft 32 and/or the steering wheel 30. The steering sensor 38 is arranged or positioned to measure or monitor a torque applied to the steering shaft 32 and/or the steering wheel 30. The steering sensor 38 is configured to provide a signal indicative of the rotational position, the angular position, and/or the torque applied to the steering shaft 32 and/or the steering wheel 30 to the actuator assembly 22.

The actuator assembly 22 is configured as a column electric power steering unit (CEPS). The actuator assembly 22 is in communication with the steering sensor 38 of the helm 20. The actuator assembly 22 is directly connected to the helm 20. The actuator assembly 22 is a variable output torque mechanism that provides a steering assist torque to assist an operator of the marine vehicle in steering the vehicle. The actuator assembly 22 provides torque multiplication of an input torque applied to the steering wheel 30 and/or the steering shaft 32 of the helm 20 to the gear assembly 24.

The actuator assembly 22 includes an actuator assembly input 40, an actuator assembly output 42, and steering assist components 44. The actuator assembly input 40 is directly connected to the steering shaft 32. The actuator assembly output 42 is operatively connected to the steering assist components 44 and the gear assembly 24. The steering assist components 44 includes an electric motor that is arranged to actuate or impart rotation to the actuator assembly output 42 in a first direction to rotate the gear assembly 24 to actuate the cable assembly 26 to move the steering device 12, in response to at least one of the torque applied to and the angular position/rotational position of the steering wheel 30 that is operatively connected to the steering shaft 32.

In at least one embodiment, the electric motor of the steering assist components 44 is arranged to actuate or impart rotation to the actuator assembly input 40 in a second direction that is disposed opposite the first direction to apply a feedback torque to the steering shaft 32. The feedback torque provides a resistance to rotation of the steering wheel 30 and/or the steering shaft 32 that an operator of the marine vehicle is able to feel. An amount of the feedback torque is based on at least one of a speed of the marine vessel and a rotational position or an angular position of the steering shaft 32 relative to an end of travel stop. For example, the amount of feedback torque may be increased as the steering shaft 32 approaches the end of travel stop and the amount of feedback torque may be decreased as the steering shaft 32 rotates away from the end of travel stop.

The gear assembly 24 is operatively connected to the actuator assembly output 42. The gear assembly 24 is configured as a step down gear assembly. The gear assembly 24 includes a first gear 50, a second gear 52, and a crank arm 54. The first gear 50 is a main gear or a drive gear. The second gear 52 is a pinion gear or a driven gear that is driven by the actuator assembly output 42. The first gear 50 is offset from the steering column axis 36 and is offset from the second gear 52. The first gear 50 is driven by the second gear 52. The first gear 50 has first diameter and the second gear 52 has a second diameter. The first diameter is greater than the second diameter.

The crank arm 54 extends from a center of the first gear 50. The crank arm 54 is disposed substantially transverse to the steering column axis 36. The crank arm 54 includes a first end 60 and a second end 62 that is disposed opposite the first end 60. The first end 60 of the crank arm 54 is pivotally connected to the center of the first gear 50. The second end 62 defines an opening 64 that at least partially receives a portion of the cable assembly 26.

A position of the crank arm 54 is based on an angular position of the steering wheel 30 of the helm 20. In response to rotation of the steering wheel 30 and/or the steering shaft 32 of the helm 20, the actuator assembly output rotates the second gear 52, and the second gear 52 rotates the first gear 50 to vary an angular position of the crank arm 54 such that the crank arm 54 moves the cable assembly 26 to move the steering device 12.

The cable assembly 26 is configured as a push pull cable assembly. The cable assembly 26 extends from the second end 62 of the crank arm 54 to the steering device 12. The cable assembly 26 includes a first portion 70, a second portion 72, a cable core 74, and a conduit 76.

The first portion 70 is coupled to the second end 62 of the crank arm 54 via the opening 64. The first portion 70 at least partially receives and is at least partially disposed about the second end 62 of the crank arm 54. The second portion 72 is operatively connected to the steering device 12. The second portion 72 is at least partially disposed about a pivot 80 of the steering device 12. The cable core 74 extends between the first portion 70 and the second portion 72.

The cable core 74 transmits a force to pivot the steering device 12 about the pivot 80. For example, in response to rotation or actuation of the steering wheel 30 and/or the steering shaft 32 of the helm 20 about the steering column axis 36, the steering shaft 32 rotates the actuator assembly input 40, the actuator assembly output 42 is aided in rotation by the steering assist components 44 and the actuator assembly output 42 rotates the second gear 52, the second gear 52 rotates the first gear 50, and the first gear 50 varies or changes an angular position of the crank arm 54. The change in angular position of the crank arm 54 moves the cable core 74 of the cable assembly 26 relative to the conduit 76. The change in angular position of the crank arm 54 results in the cable core 74 at least one of pushing or pulling the steering device 12 to move the steering device 12 about the pivot 80 to steer the marine vessel.

The conduit 76 is disposed about the cable core 74. The conduit 76 extends between the first portion 70 and the second portion 72. The conduit 76 is configured as a sheath that is configured to protect the cable core 74.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A marine electric power steering system comprising:

an actuator assembly having an actuator assembly input, an actuator assembly output, and an electric motor arranged to actuator the actuator assembly output, the actuator assembly input being operatively connected to a steering shaft that extends along a steering column axis;

a step down gear assembly, comprising:

a first gear driven by a second gear, and a crank arm extending from the first gear, the crank arm is disposed transverse to the steering column axis; and a cable assembly extending from an end of the crank arm to a steering device, in response to rotation of the steering shaft about the steering column axis, the actuator assembly output rotates the second gear, and the second gear rotates the first gear, such that the crank arm moves the cable assembly to move the steering device.

2. The marine electric power steering system of claim 1, wherein the first gear has a first diameter and the second gear has a second diameter.

3. The marine electric power steering system of claim 2, wherein the first diameter is greater than the second diameter.

4. A marine electric power steering system comprising:

an actuator assembly having an actuator assembly input operatively connected to a steering shaft and an actuator assembly output;

a step down gear assembly operatively connected to the actuator assembly output, the step down gear assembly comprising a crank arm pivotally connected to a first gear; and a cable assembly operatively connected to the crank arm and a steering device.

5. The marine electric power steering system of claim 4, wherein the step down gear assembly further comprising: a second gear that is drivably connected to the actuator assembly output and arranged to drive the first gear.

6. The marine electric power steering system of claim 5, wherein the crank arm has a first end that is pivotally connected to a center of the first gear and a second end that at least partially receives a portion of the cable assembly.

7. The marine electric power steering system of claim 6, wherein the cable assembly includes a first portion that is operatively connected to the second end of the crank arm, a second portion that is operatively connected to the steering device, and a cable core that extends between the first portion and the second portion.

8. The marine electric power steering system of claim 7, wherein the actuator assembly further including an electric motor operatively connected to the actuator assembly output.

9. The marine electric power steering system of claim 8, wherein the electric motor is arranged to rotate the actuator assembly output in a first direction to rotate the second gear to rotate the first gear and adjust a position of the crank arm to at least one of push and pull the cable core to move the steering device.

10. The marine electric power steering system of claim 9, wherein the cable assembly further comprising a conduit disposed about the cable core and extending between the first portion and the second portion.

11. The marine electric power steering system of claim 10, wherein the electric motor is configured to rotate actuator assembly input in a second direction disposed opposite the first direction to apply a feedback torque to the steering shaft.

12. The marine electric power steering system of claim 11, wherein the feedback torque is based on at least one of a speed of a marine vessel and a rotational position of the steering shaft.

13. A marine electric power steering system comprising:

a steering sensor arranged to provide a signal indicative of at least one of a rotational position, an angular position, and a torque applied to a steering shaft;

an actuator assembly having an actuator assembly input operatively connected to the steering shaft, an actuator assembly output, and an electric motor arranged to actuate the actuator assembly output;

a step down gear assembly operatively connected to the actuator assembly output, the step down gear assembly comprising a crank arm pivotally connected to a first gear and a second gear arranged to drive the first gear; and a cable assembly operatively connected to the crank arm and a steering device.

14. The marine electric power steering system of claim 13, wherein in response to the signal, the electric motor is arranged to rotate the actuator assembly output in a first direction to rotate the second gear to rotate the first gear and adjust a position of the crank arm to at least one of push and pull the cable assembly to move the steering device.

15. The marine electric power steering system of claim 13, wherein the electric motor is configured to rotate actuator assembly input in a second direction disposed opposite the first direction to apply a feedback torque to the steering shaft.

16. The marine electric power steering system of claim 15, wherein the feedback torque is based on at least one of the rotational position, the angular position, and the torque applied to a steering shaft.

* * * * *